United States Patent [19]

Schirnig et al.

[11] 4,247,381

[45] Jan. 27, 1981

[54] FACILITY FOR CONDUCTING ELECTRICAL POWER TO ELECTRODES

[75] Inventors: Joachim Schirnig, Rheinfelden; Hanspeter Alder, Flurlingen; Jobst Weber, Rheinfelden, all of Fed. Rep. of Germany

[73] Assignee: Swiss Aluminum Ltd., Chippis, Switzerland

[21] Appl. No.: 117,875

[22] Filed: Feb. 4, 1980

[51] Int. Cl.[3] ..... C25C 3/16; C25C 3/04; C25C 0/6; C25C 7/02

[52] U.S. Cl. ..... 204/225; 204/64 R; 204/67; 204/70; 204/279; 204/286; 204/243 R; 174/152 R

[58] Field of Search ..... 174/152 R; 204/64 R, 204/67, 70, 243 R-247, 279, 289, 286, 288, 225

[56] References Cited

U.S. PATENT DOCUMENTS

| | | | |
|---|---|---|---|
| 2,471,531 | 5/1949 | McIntyre et al. | 204/286 X |
| 3,037,928 | 6/1962 | Hass et al. | 204/286 |
| 3,607,685 | 9/1971 | Johnson | 204/243 R |
| 3,607,708 | 9/1971 | Priscu et al. | 204/286 X |
| 3,723,287 | 3/1973 | Elliott | 204/243 R |
| 4,177,128 | 12/1979 | Rahn | 204/243 R |

FOREIGN PATENT DOCUMENTS

| | | | |
|---|---|---|---|
| 1167040 | 12/1961 | Fed. Rep. of Germany | 204/243 R |

*Primary Examiner*—T. Tung
*Assistant Examiner*—D. R. Valentine
*Attorney, Agent, or Firm*—Bachman and LaPointe

[57] ABSTRACT

The new conductor facility for electrodes, in particular for electrodes immersed in corrosive molten salts, features the following components:

(a) A graphite pipe or tube which is open at both ends, fits tightly into a recess in the electrode and passes through the furnace or cell wall or roof.

(b) A metallic electrical conductor, which is positioned inside the graphite pipe and can be pushed forward inside it, is made of a metal with a melting point lower than the temperature of the molten salt charge and makes contact with the electrode in the liquid state at the operating temperature of the furnace or cell.

(c) A protective pipe, which surrounds the graphite pipe and is made of a dense, electrically insulating ceramic material, has one end tightly embedded in the electrode and the other end passing through the wall or roof, and is stable under the operating conditions of the furnace or cell.

The said conductor facility is suitable for smelting furnaces, electrolytic cells for the production of metals, in particular from their chlorides dissolved in chloride bearing melts, and for equipment of a similar kind. It is self-regenerative and permits operation under conditions of constant power supply.

12 Claims, 1 Drawing Figure

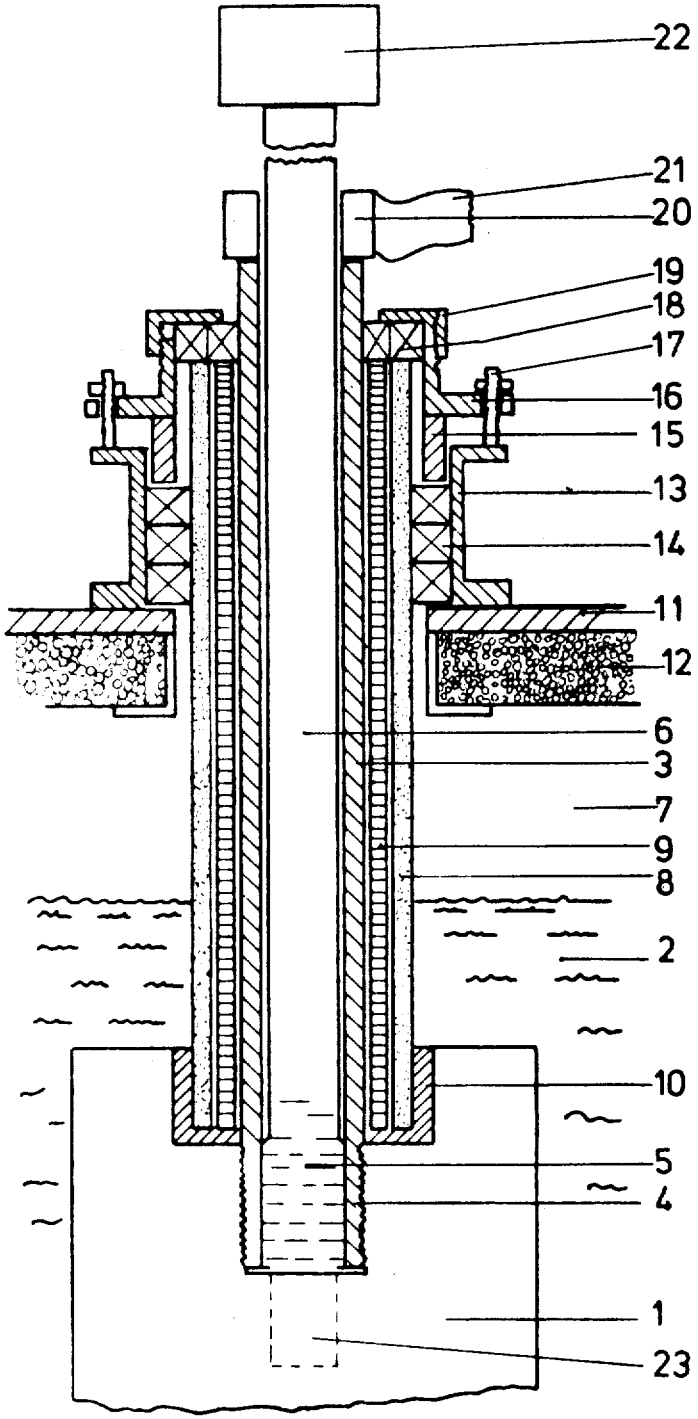
22
21
20
19
18
17
16
15
13
14
11
12
6
3
7
9
8
2
10
5
4
1
23

FACILITY FOR CONDUCTING ELECTRICAL POWER TO ELECTRODES

BACKGROUND OF THE INVENTION

The invention relates to an improved facility for conducting electrical power to electrodes, in particular to electrodes immersed in corrosive salt melts, amongst others for the electrolysis of fused halide salt melts, in particular a chloride melt containing dissolved aluminum chloride, and such that the said device is stable in operation and functions with a low voltage drop. This device is also suitable for equipment for heating fused salt melts with alternating currents, for electroplating articles in fused salt melts and similar equipment.

In such equipment, and in particular in the electrolysis of metals in fused halide salt melts, the design of the container for the fused salts, in particular the cell and the arrangement of the electrodes, are to a large degree determined by the fact that for corrosion reasons one must avoid passing the metallic conductor through the fused salts.

In the case of the Hall-Heroult electrolytic process for the extraction of aluminum, this is achieved by casting iron bars in the cathodic carbon floor of the cell and conducting the power into the carbon floor and the liquid metal via these bars. In the anode part the metal conductor rods are embedded and packed into the carbon blocks with pitch.

The electrolytic production of magnesium makes use of vertical electrodes. In that case graphite plates which project out of the melt are employed as the anodes, the power being passed directly into these; one accepts in that case a relatively high voltage drop, a heat loss and regular anode changes which are required because the anodes burn off at the melt/gas interface.

If now a highly conductive metal such as copper or high nickel steels are used as the conductor bars, then the voltage drop is lowered. However, at the same time the conductor bars are attacked by anode gas, liquid metal and molten salts, and, if the electrode plates are made of graphite, by carbon viz., a form of attack which no metal can withstand for very long in the temperature range 550°-800° C. Furthermore, the electrode material, usually graphite, if desired also a baked artificial carbon mass, always has some residual porosity. The result of this is that the melt steadily migrates through the electrode material, comes in contact with metallic conductor in the electrode and attacks it.

A solution to this problem should be of great technical advantage, that is, the conduction of electrical power to and from the electrodes of a furnace or cell containing a melt, or the anodes and cathodes of an electrolytic cell, via conductor bars which are made of highly conductive metal, and are not attacked by the ambient gases or the melt, or are effectively protected from attack by the surrounding media. This is particularly true for the electrolysis of metals from fused halide salts, for example, the production of magnesium from a chloride melt contaning dissolved magnesium chloride, alkali metals from their chlorides and finally aluminum from an alkali halide melt containing dissolved aluminum chloride.

A number of different solutions have already been proposed.

For example, the U.S. Pat. No. 3,838,384 describes a metallic conductor which passes through the cell wall and therefore is protected from corrosive attack. The conductor is provided with a protective sleeve, impervious to gases and fluids and made of graphite, which encloses the conductor after it penetrates the outer cell wall, deep into the graphite electrode. The protective sleeve is coated with highly conductive pyrolytic graphite to reduce its porosity and improve its protective characteristics. This sleeve is pressed tightly into the electrode at one end and at the other end sealed against penetration by electrolyte by means of a kind of packed box facility on the outer cell wall. In addition, this end of the conductor is cooled somewhat so that the electrolyte freezes there.

In U.S. Pat. No. 3,809,749 the same problem is solved by retaining the highly conductive graphite sleeve, which is as impervious as possible. In addition, however, a positive pressure of inert gas, higher than the pressure in the cell, is maintained between the conductor and the protective sleeve to prevent electrolyte entering the sleeve. At the same time this gas pressure or the flow of gas indicates if the electrode is damaged in any way.

Both solutions suffer from the disadvantage that the metallic conductor is protected only as long as the mechanical and physical means for preventing penetration of the corrosive surrounding media remains intact or undisturbed. An additional disadvantage is the fact that, although the metallic conductor itself exhibits a low voltage drop, the mechanical and therefore the electrical contact between the solid metal and the graphite deteriorate with time. In particular, the migration of the fused salt charge through the electrode material and finally through the graphite sleeve, even when this is coated with pyrolytic graphite, can not be prevented completely by the proposed inert gas, so that it ultimately leads to attack of the metallic conductor.

It is an object of the present invention to avoid such disadvantages and, in particular to develop a means of power conduction which is stable in operation and functions with a low voltage drop.

SUMMARY OF THE INVENTION

This object is achieved by way of the invention in that the means of power conduction features the following components:

(a) a graphite pipe or tube, which is open at both ends, fits tightly into a recess in the electrode and passes through the cell wall;

(b) a metallic electrical conductor, which is positioned inside the graphite pipe and can be pushed forward inside it, is made of a metal with a melting point lower than the temperature of the melt and makes contact with the electrode in the liquid state at the operating temperature of the cell or furnace;

(c) a protective sleeve, which surrounds the graphite pipe and is made of a dense, electrically insulating ceramic material, has one end tightly embedded in the electrode and the other end passing through the cell wall, and is stable under the operating conditions.

In use in an electrolytic reduction cell the metallic conductor is preferably made of the same metal as that being produced in the cell or in the case of a furnace the metal in the principle salt in the melt.

According to a further development of the invention a glass pipe is to advantage introduced between the graphite pipe and the ceramic pipe.

The device according to the invention for conducting electrical power exhibits the following advantages:

(1) A metallic conductor of high electrical conductivity is provided.

(2) In the region of the electrode the end of the metal conductor passing through the graphite pipe melts and forms a liquid bed there, which automatically adjusts to the contact surface and therefore provides excellent electrical contact with the electrode and with the end of the graphite pipe fitting into the electrode.

(3) Any corrosion products, in particular metal halides formed by unavoidable migration of the melt through the electrode material and due to subsequent reaction with conductor material, dissolve in the penetrating melt again and are thus removed, in fact again by migration through the electrode material, so that the contact is always renewed. The cell or the furnace or the like can therefore operate under conditions of constant electrical supply for unlimited periods.

(4) If, in the case of the electrolysis of aluminum chloride, the metal conductor is made of aluminum, or of magnesium in the case of the electrolysis of magnesium chloride, the corrosion products are the metal chlorides which are anyway already present in the electrolytic cell. There is therefore no possibility of contaminating the electrolytically produced metal by another metal.

(5) The consumption of conductor metal, corresponding to the degree of corrosive attack at the contact electrode plate, as has been established by experience, is very slight and is more than compensated for by the electrical advantages viz., by the very low voltage drop and by the fact that the current density is optimized at the contact interface.

The metallic conductor may however also be made out of metals other than that produced electrolytically in the process in question, provided this other metal is not harmful to the molten salt charge or to the metal produced. For example, for a cell producing aluminum, conductors made of magnesium can be considered, the result being that an aluminum alloy with a low magnesium content is produced.

BRIEF DESCRIPTION OF THE DRAWING

The invention will now be described in greater detail with the help of an exemplified embodiment which is illustrated schematically in the accompanying drawing. This shows a vertical cross section through an electrical conductor facility for electrodes which are positioned vertically and are immersed in the melt of molten salts for the electrolytic production of aluminum from aluminum chloride.

DETAILED DESCRIPTION

The electrode plate 1, which is normally made of graphite, is immersed in the liquid halide salt melt 2. A graphite pipe 3 which is highly conductive to electricity and features a low degree of porosity, as a result of its method of manufacture, is screwed into a recess 5 in the electrode plate 1 by means of a thread 4. Permeability of the graphite pipe can be avoided by depositing pyrolytic carbon in the pores e.g. by cracking carbon bearing gas or impregnating with coal tar and subsequently baking. An aluminum rod 6 is fitted into this graphite pipe 3 in such a way that it can be displaced freely but without having much free space around it. In the lowest part where, as a result of the good thermal conductivity of the electrode plates, the temperature near the hole 5 is practically that of the fused salt bath 2—which is above the melting point of aluminum—the solid aluminum melts and provides electrical contact in the liquid state. This contact interface provided by the liquid aluminum corresponds to the shape of the graphite pipe and the base of the recess, resulting therefore in a low contact resistance. To provide protection from the corrosive action of the melt 2 and the chloride bearing atmosphere 7 above it, the graphite pipe 3 is surrounded by an electrically insulating, dense, ceramic pipe 8 made for example of aluminum oxide, magnesium oxide, quartz or silicon oxi-nitride. Between the insulating pipe 8 and the graphite pipe 3 there is, usefully, a glass pipe 9. This combination of protective pipes 8 and 9 is particularly successful in preventing the salt melt from penetrating through to the graphite pipe 3 and therefore premature feed of current directly into the molten salt charge. Both pipes 8 and 9 are introduced into the electrode plate 1 to the point where the seal 10 is provided by a refractory cement or graphite foil. Graphite foil has the advantage that it possesses a certain elasticity i.e. so that the thermal expansion of the ceramic pipe 8 can be accommodated.

The top 11 to the cell is made of metal and is insulated by means of a refractory material 12. The conductor passes through the lid 11, is sealed and held in place by a facility comprising a housing 13, packing 14 and pressure ring 15 which can be tightened by means of screws 17 via the ring-shaped flange 16. The protective pipes 8 and 9 are also sealed at the head by means of a packing 18 which is pressed by the screw-fit lid 19 screwed onto the flange 16. The graphite pipe 3 must be electrically insulated from the lid 11, therefore at least the packing 18 must be an insulating material. Both lots of packing 14 and 18 can for example be made of impregnated asbestos fibers. If necessary, the electrodes can be also be supported in a conventional manner. The electrical contact with the aluminum rod 6 is made usefully via a sliding contact piece 20, the electrical supply being made by way of a flexible band 21.

The aluminum rod 6 can be advanced automatically under the force of its own weight. If necessary, a weight 22, compressive spring or an electromagnetic advancing device can be provided at the head of the rod, to push the aluminum rod down under control.

As explained above, the aluminum rod 6 is consumed progressively at its lower end. It is therefore useful to provide the rod at its upper end with e.g. a thread which can be readily connected to another, following rod at the appropriate time.

It can also be desirable not to limit the metallic conductor to the depth of the threaded recess 5, but to a lower point in the electrode plate 1. A continuation 23 to the recess 5, below the threaded part, can then be provided in the manner shown by broken lines in the drawing.

In the described embodiment of the invention the parts of the conductor arrangement projecting into the cell are round in cross section. It is however completely within the scope of the invention that these parts can be of a different cross-sectional shape e.g. rectangular in cross section. The glass sleeve can also be made up of glass strips whereby it is then useful to choose a grade of glass which exhibits a certain degree of plasticity at the operating temperature so that the individual strips fuse together along their edges, or at least deform so that they fit together without forming any gaps.

The described exemplified embodiment hangs vertically into the cell. The same design is however in principle also applicable for electrode plates which lie horizontal and either lie directly on the brick work of the cell wall or else separated from the cell wall by a space filled with the melt. It can be useful to install the conductor facility such that it is slightly inclined downwards towards the cell interior so that the molten conductor rod material always fills recess 5 as well as possible.

EXAMPLE

A test cell was built as follows: A steel shell with a base area of 20 cm×20.5 cm and 50 cm high was lined with a 5 cm thick double glass wall and 3 cm thick, high purity aluminum oxide bricks on top, so that the interior of the cell had a base area of 12.5 cm by 12.5 cm and a height of 46 cm. At half of the cell height two graphite plates 10 cm high, 12.5 cm broad and 4.2 or 5.5 cm thick were suspended, each resting against a cell wall and facing each other with a spacing of 28 mm between them. A conventional conductor in the form of a copper bolt was used for the cathodically polarized plate. This bolt was 1.5 cm in diameter and was screwed into the electrode plate to a depth of 3.5 cm. Outside the graphite plate the copper bolt was protected by a close fitting glass tube of wall thickness 2 mm and a dense aluminum oxide tube of wall thickness 2.5 mm, both of which penetrated the graphite to a depth of 1.5 cm and were sealed there by a refractory sealing compound.

The other, anodically polarized graphite plate was fitted with a conductor arrangement according to the invention. This comprised an aluminum rod, 1.4 cm in diameter, a graphite tube of 2 mm wall thickness, and an aluminum oxide tube of 2.5 mm wall thickness, all arranged concentrically. The graphite tube was screwed into the graphite electrode to a depth of 24.5 mm and both protective tubes penetrated the electrode to a depth of 1.5 cm, and were sealed there by a refractory sealing compound.

Both conductors penetrated the lid via packed box facilities, the lid being made of a metal plate clad with a refractory cement. A central pipe in the middle of the cell served to draw off chlorine and as a feed pipe. The whole cell was situated in an electrically heated furnace.

7 kg charge of electrolyte made up of 20% $AlCl_3$, 40% LiCl, and 40% NaCl was melted directly in the cell. The level of the liquid melt in the cell was 8 cm above the electrodes. After reaching a temperature of 700°-730° C., the power was switched on and increased stepwise to 200 A which, with an electrode surface area of 125 $cm^2$, led to a current density of 1.6 $A/cm^2$. The total difference in potential between the clamps on the conductor rods amounted to 3.6–4.4 volt.

The lowest part of the aluminum rod of the anodically polarized conductor melted on heating to the electrolyte temperature. This led on the one hand to good electrical contact with the graphite tube and the anode; on the other hand it made the whole arrangement gas tight and, as a result of heat conduction through the aluminum rod, prevented local overheating of the contact due to too high a current density. The contact area in the graphite anode plate was about 12.5 $cm^2$ so that at 200 A the current density was approximately 16 $A/cm^2$. The metallic aluminum which was oxidized by chlorine, partly at the contact surface, partly in the graphite pores, was compensated for by sliding the solid aluminum rod forward. This was done automatically by placing a weight of about 500 grams on the end of the rod outside the cell.

The duration of the trial was 116 hours. During this time the voltage drop on the anode between the upper end of the aluminum rod and a platinum probe in the anode plate was measured continuously. The voltage drop measured this way varied between 0.1 and 0.3 volt, which indicates good transfer of power. With this freshly installed anode, a total of 112 grams aluminum was consumed, i.e. approximtely 1 gram aluminum/hour or about 1.5% of the quantity of metal produced in the cell in this time.

At the cathode conductor the voltage drop at the copper-graphite cathode contact increased steadily by about 0.6 volt to approximately 1.2 volt towards the end of the trial. At the same time the copper content in the aluminum produced increased from 0.004% at the start to 0.010% at the end. On completion of the trial the copper bolt sat loose in the electrode, as its thread had been destroyed by the melt which had penetrated through to it.

The melt had also risen in the space between the copper bolt and the glass tube and led to corrosion of the surface of the bolt in that region.

The fact that both a conventional copper conductor and a conductor device according to the invention were employed in this trial made it possible to compare the conductors directly with each other. The results reported here demonstrate the superiority of the device according to the invention over the conventional conductor.

With respect to the consumption of conductor metal, it should be noted that in cells with bipolar electrodes, where a conductor facility is required only for the first and last electrode in the series, this consumption is reduced approximately in accordance with the number of electrolysis spaces and in proportion to the quantity of metal produced.

What is claimed is:

1. Electrical conductor facility for electrodes immersed in a corrosive molten salt charge in a smelting furnace or electrolytic cell for the production of metals having a furnace or cell wall or roof, including:
   (a) a graphite pipe or tube open at both ends, fitting tightly into a recess in said electrode and passing through the wall or roof,
   (b) a metallic electrical conductor positioned inside the graphite pipe, wherein said conductor is made of a metal with a melting point lower than the temperature of the molten salt charge and makes contact with the electrode in the liquid state at the operating temperature of the furnace or cell, and
   (c) a protective pipe surrounding the graphite pipe made of a dense, electrically insulating ceramic material having one end tightly embedded in the electrode and the other end passing through the wall or roof, wherein said protective pipe is stable under the operating conditions of the furnace or cell.

2. Facility according to claim 1 wherein said metallic conductor can be pushed forward inside said pipe.

3. Facility according to claim 1 for the production of metals from their chlorides dissolved in chloride bearing melts.

4. Facility according to claim 2 wherein the metallic conductor is made of the same metal as that being produced electrolytically in the cell or is present as the main salt in the smelting furnace.

5. Facility according to claim 4 wherein the cell is for producing aluminum and the metallic conductor is made of aluminum.

6. Facility according to claim 4 wherein the cell is for producing magnesium and the metallic conductor is made of magnesium.

7. Facility according to claim 1 wherein the protective ceramic pipe is made of aluminum oxide, magnesium oxide, aluminum-magnesium spinel, quartz or silicon carbide.

8. Facility according to claim 1 wherein a glass pipe is positioned between the graphite pipe and the protective ceramic pipe.

9. Facility according to claim 8 wherein the ceramic pipe and the glass pipe are substantially the same length.

10. Facility according to claim 1 wherein at its free end the graphite pipe extends further than the ceramic pipe.

11. Facility according to claim 1 wherein at its free end the metallic conductor extends further than the graphite pipe and is connected to an electrical power supply.

12. Facility according to claim 1 wherein the facility is held in place and sealed off by means of a packed box arrangement which is mounted on the wall or roof of the cell or furnace and which forms a seal around the ceramic pipe and the graphite pipe by means of a packing material.

* * * * *